US006846024B1

(12) United States Patent
Palzkill

(10) Patent No.: US 6,846,024 B1
(45) Date of Patent: Jan. 25, 2005

(54) SECURITY COVER SYSTEM FOR CARGO CONTAINER LATCH

(75) Inventor: Raymond G. Palzkill, Omaha, NE (US)

(73) Assignee: Gabriel Technologies Corp., Omaha, NE (US)

( * ) Notice: Subject to any disclaimer, the term of this patent is extended or adjusted under 35 U.S.C. 154(b) by 468 days.

(21) Appl. No.: 10/066,838

(22) Filed: Feb. 4, 2002

Related U.S. Application Data

(60) Provisional application No. 60/280,241, filed on Mar. 30, 2001.

(51) Int. Cl.[7] ..... E05C 19/00

(52) U.S. Cl. ..... 292/261; 292/327; 292/307 R; 292/281

(58) Field of Search ..... 292/327, 261, 292/307 R, 318–321, 331, 281, DIG. 2, 286, 287; 70/32–34, 9–12, 54–56

(56) References Cited

U.S. PATENT DOCUMENTS

| | | | | |
|---|---|---|---|---|
| 5,118,149 A | | 6/1992 | Emmons | |
| 5,168,258 A | * | 12/1992 | Radke | 340/542 |
| 5,749,610 A | | 5/1998 | Brammall et al. | |
| 5,769,470 A | * | 6/1998 | Toyomura | 292/327 |
| 5,878,604 A | | 3/1999 | Stone et al. | |
| 6,009,731 A | | 1/2000 | Emmons et al. | |
| 6,010,166 A | | 1/2000 | Hamilton et al. | |
| 6,036,240 A | | 3/2000 | Hamilton et al. | |
| 6,265,973 B1 | | 7/2001 | Brammall et al. | |
| 6,357,266 B1 | * | 3/2002 | Van Buren | 70/56 |
| 6,464,269 B1 | * | 10/2002 | Wilhelm et al. | 292/307 R |
| 6,519,982 B1 | * | 2/2003 | Brammall et al. | 70/56 |
| 6,581,419 B1 | * | 6/2003 | Strodtman | 70/56 |
| 6,581,425 B1 | * | 6/2003 | Brown et al. | 70/212 |

* cited by examiner

*Primary Examiner*—John B. Walsh

(57) ABSTRACT

A security system for a shipping container includes a cover and seal pin, and a special removal tool for removing the pin from the cover. The cover includes a vertical channel with top and bottom plates mounted therein to form a rearwardly opening box. A pair of vertically aligned apertures in the top and bottom plates are aligned with apertures in ears of a hasp on the shipping container, and receive the seal pin to secure the cover to the container. A seal pin includes an elongated shaft with annular grooves in the upper and lower ends. A pair of end caps each includes an annular groove on their interior surfaces that correspond with the shaft grooves to retain a locking ring within the pair of aligned grooves, when the caps are snapped on the ends of the shaft. The locking rings prevent removal of the caps, once snapped into place on the shaft. A removal tool includes a hydraulic pump with a punch secured to a piston of the pump. A punch housing has a gripping structure on the lower end that will grip a seal pin end cap, while the punch is driven through the end cap to push the shaft free of the end cap and release the seal pin.

1 Claim, 7 Drawing Sheets

SECURITY COVER SYSTEM FOR CARGO CONTAINER LATCH

CROSS-REFERENCES TO RELATED APPLICATIONS

This application claims priority based upon a Provisional Patent Application entitled SECURITY COVER FOR CARGO CONTAINER LATCHES, Ser. No. 60/280,241, filed Mar. 30, 2001.

STATEMENT AS TO RIGHTS TO INVENTIONS MADE UNDER FEDERALLY SPONSORED RESEARCH AND DEVELOPMENT (Not applicable)

BACKGROUND OF THE INVENTION

1. Field of the Invention

The present invention relates generally to apparatus for securing the latch of a shipping container, and more particularly to an improved security cover system for preventing unauthorized access to a shipping container.

2. Background Information

Shipping containers are widely used in the transportation of various types of goods, both domestically and internationally. However, the task of securing such containers against break-ins has proven difficult to solve.

Prior art attempts include such devices as hasp protectors and various bolt seals. For example, U.S. Pat. No. 5,118,149 discloses a container hasp protector with a metal box with an open rearward side. A shield plate on the front face extends between the sides to form upper and lower openings in the face between the shield plate and the top and bottom walls of the box. The box encloses the containers hasp, to protect against damage by a thief.

Although this apparatus provides protection for the hasp, it still leaves the shank of the security seal/pin open for tampering or cutting, through the openings in the front face.

Similarly, padlock-type security devices such as those disclosed in U.S. Pat. Nos. 5,477,710, 5,146,771 and 4,898,008 suffer the problem of exposure of the shanks or shackles to bolt-cutters or other shears.

U.S. Pat. Nos. 6,010,166, 6,009,731 and 6,036,240 all disclose bolt seal lock devices that utilize a pin with an enlarged head on an upper end and a lock body on a lower end, the shank of the pin journaled though aligned apertures in a housing to cover a portion of a keeper bar and prevent operation of the keeper bar while the cover is in place. However, each of these devices incorporates an enlarged locking body which is preferably releasable, and exposed on one side. This exposed locking body can therefore be accessed by unauthorized persons, and potentially permit tampering and prying of the locking body off the shank of the pin.

BRIEF SUMMARY OF THE INVENTION

It is therefore a general object of the present invention to provide an improved security system for cargo container latches.

Another object of the present invention is to provide a latch security system with an improved seal pin, security cover and removal tool.

A further object is to provide a cargo latch security system which does not expose any portion of the shank of the pin, when secured to the container.

Yet another object is to provide an improved security system for a cargo latch which is simple and economical to manufacture.

These and other objects of the present invention will be apparent to those skilled in the art.

The security system for a shipping container of the present invention includes a cover and seal pin, and a special removal tool for removing the pin from the cover. The cover includes a vertical channel with top and bottom plates mounted therein to form a rearwardly opening box. A pair of vertically aligned apertures in the top and bottom plates are aligned with apertures in ears of a hasp on the shipping container, and receive the seal pin to secure the cover to the container. The seal pin includes an elongated shaft with annular grooves in the upper and lower ends. A pair of end caps each includes an annular groove on their interior surfaces that correspond with the shaft grooves to retain a locking ring within the pair of aligned grooves, when the caps are snapped on the ends of the shaft. The locking rings prevent removal of the caps, once snapped into place on the shaft. The removal tool includes a hydraulic pump with a punch secured to a piston of the pump. A punch housing has a gripping structure on the lower end that will grip a seal pin end cap, while the punch is driven through the end cap to push the shaft free of the end cap and release the seal pin.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
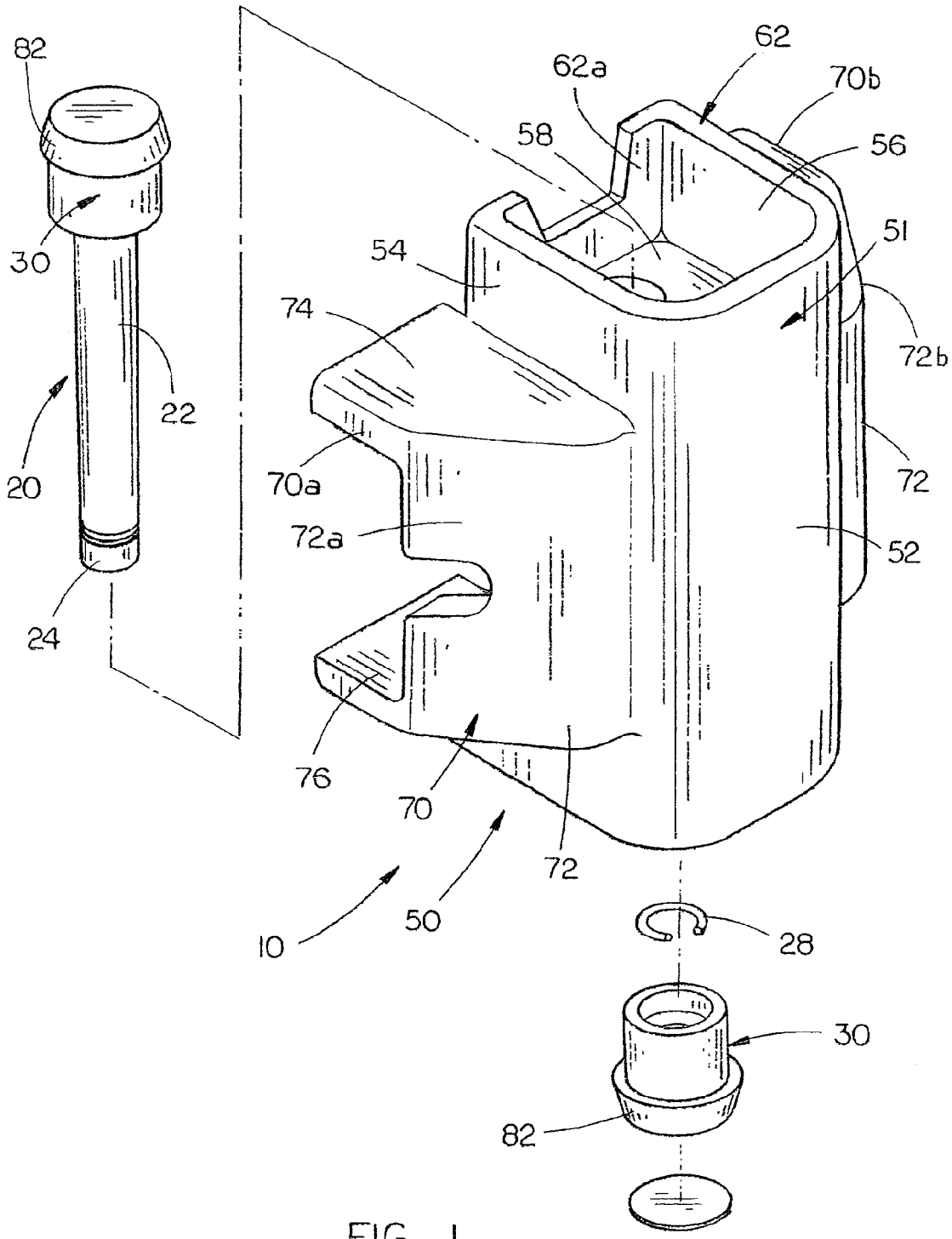
FIG. 1 is a pictorial view of the security cover and associated seal pin, prior to mounting on a shipping container.
Figure 10:
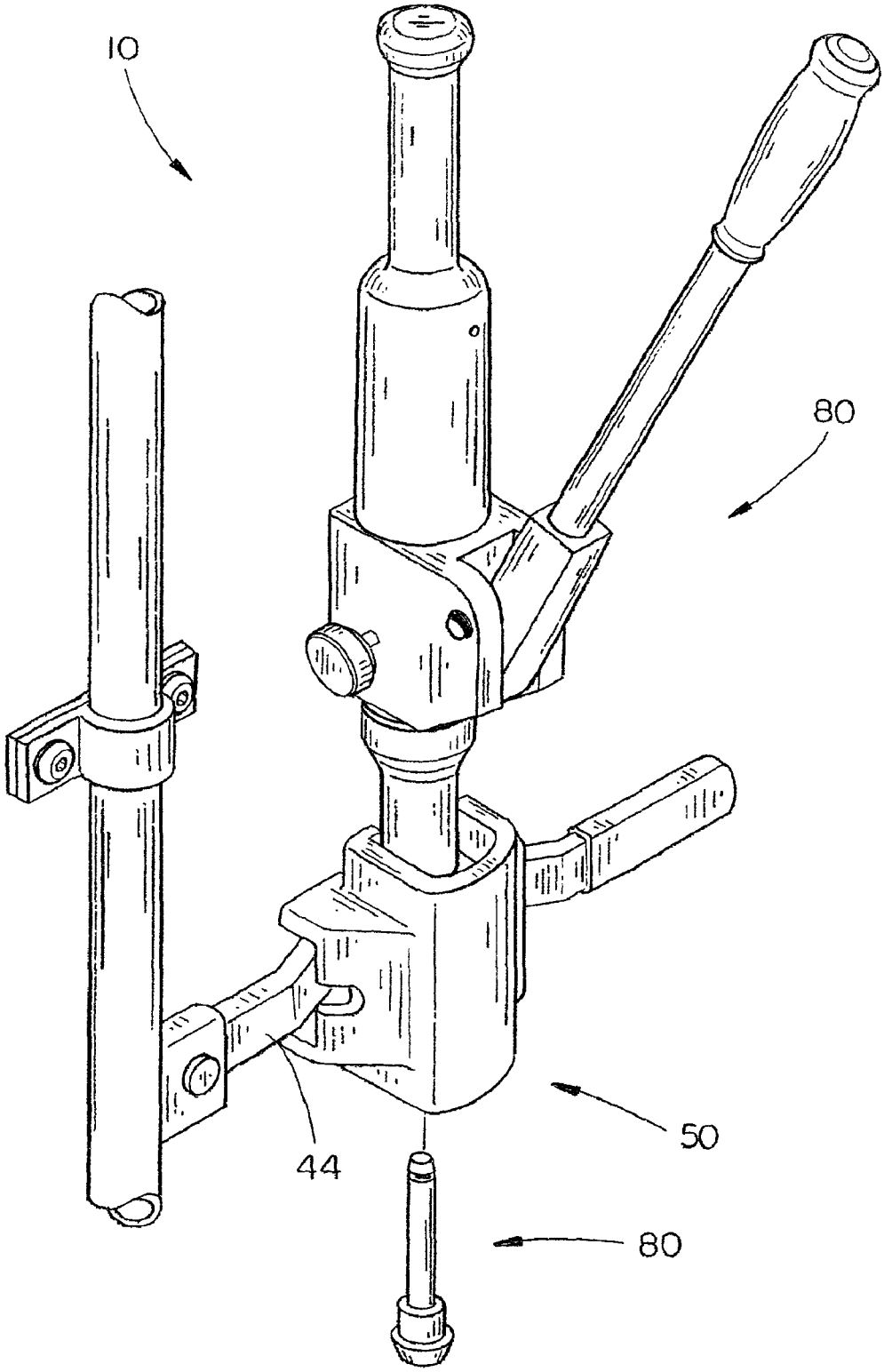
FIG. 10 is a pictorial view of the removal tool in operation, removing the seal pin from the cargo latch of a shipping container.

Referring now to the drawings, in which similar or corresponding parts are identified with the same reference numeral, and more particularly to FIGS. 1 and 10, the security system of the present invention is designated generally at 10 and includes three main components, namely, a seal pin 20, a security cover 50 and a removal tool 80.

Figure 6:
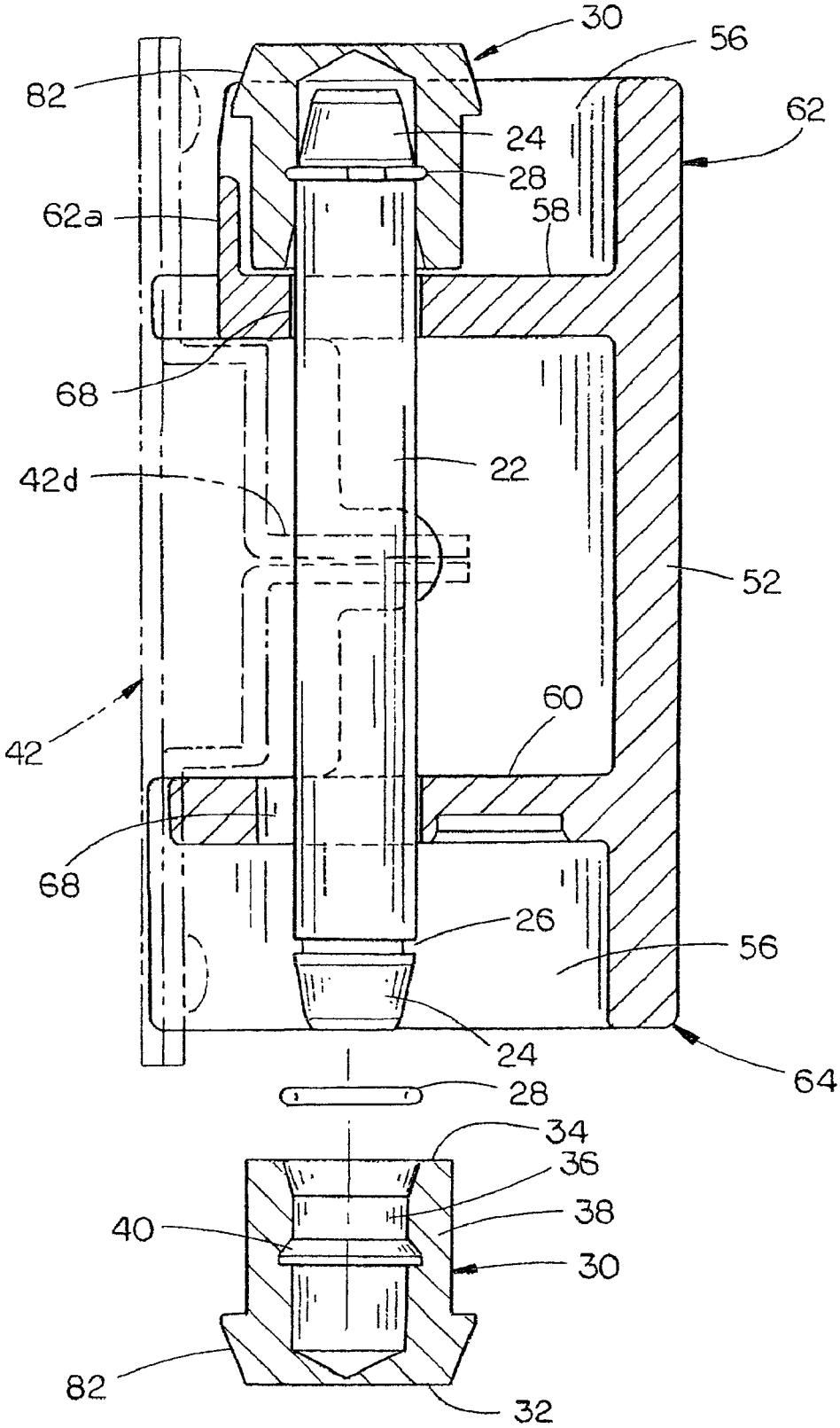
FIG. 6 is a sectional view through the security cover and top and bottom caps of the seal pin, with the pin shank shown in elevational view and installed in the cover.

Referring to FIGS. 1 and 6, the seal pin 20 is shown in detail. Seal pin 20 is preferably formed of a hardened steel or similar material which is not easily bent, cut or broken. Seal pin 20 includes an elongated cylindrical shaft 22 with identical opposing ends 24. Ends 24 are tapered to form a slightly conical shape, with a decreasing cross-sectional diameter at the extreme ends.

An annular groove 26 is formed around the circumference of the shaft adjacent each end 24, and located at the inward end of each tapered surface. Each groove 26 will receive a locking ring 28 therein, to retain end caps 30 in position on ends 24, as described in more detail hereinbelow. It can be seen that the tapered surface of each end 24 will permit the locking rings 28 to gradually expand in diameter, until they fall in to the associated groove 26 on the pin shaft 22.

End caps 30 are case hardened steel and generally cylindrical in shape, with an outward end 32 and an inward end 34. A generally cylindrical bore 36 is formed in the inward end of each cap 30 and extends along the longitudinal axis of the cap towards the outward end 32, to form a generally cylindrical sidewall 38 in cap 30. Bore 36 has a diameter slightly greater than the diameter of the pin shaft 22, to slidably receive the shaft 22 therein. An annular groove 40 projecting radially outward into the sidewall 38 is formed to receive the locking ring 28 therein, when the locking ring 28 is positioned within groove 26 on shaft 22, and the pin shaft 22 is inserted within the end cap 30. It can be seen that the radial outward expansion of locking ring 28 into groove 40 of end cap 30 while retained within groove 26 of shaft 22, secures the shaft 22 in the end cap 30.

Preferably, groove 40 in end cap 30 has a generally conical surface, having a reducing diameter from the outward end to the inward end thereof. Similarly, bore 36 preferably includes a conical entry surface, reducing in diameter from the inward end towards the outward end thereof for a short length of the bore. These conical surfaces assist in the entry of the pin shaft 22 with locking ring 26 into the end cap 30.

Figure 3:
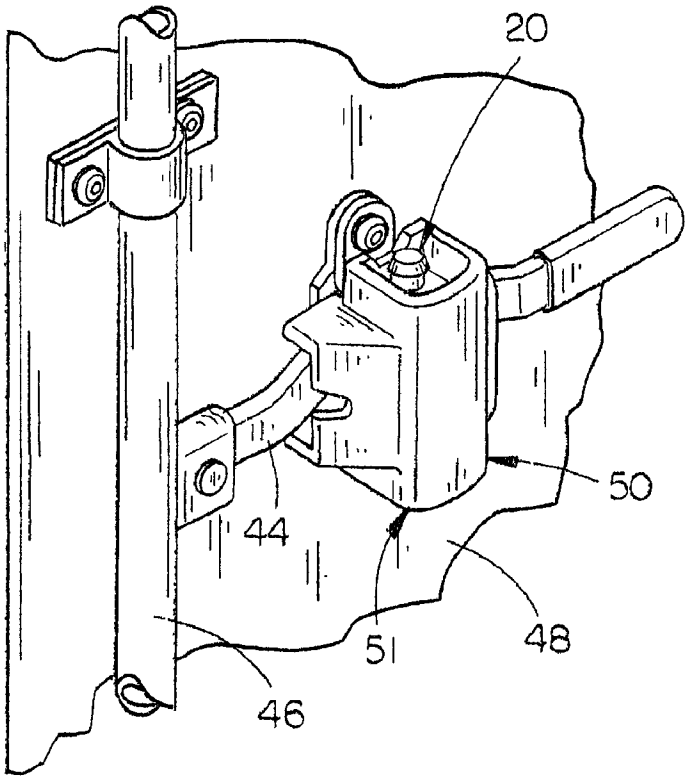
FIG. 3 is a pictorial view similar to FIG. 2, but with the cover and seal pin secured in position on the latch.
Figure 2:
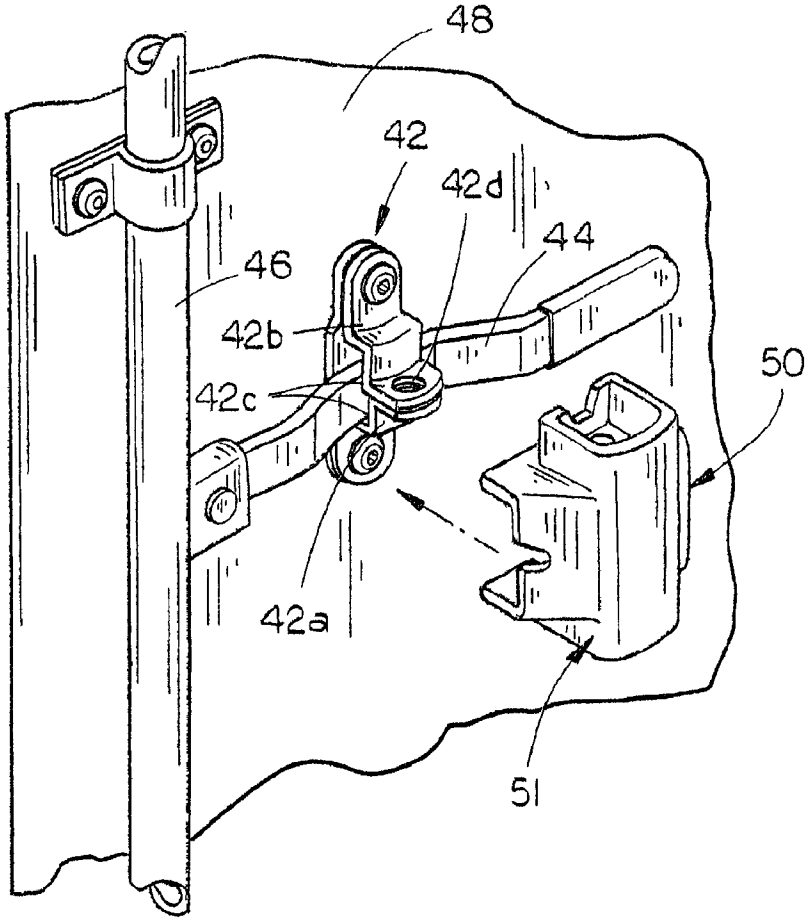
FIG. 2 is a pictorial view of the security system showing the cover being installed on the hasp of a shipping container latch.
Figure 4:
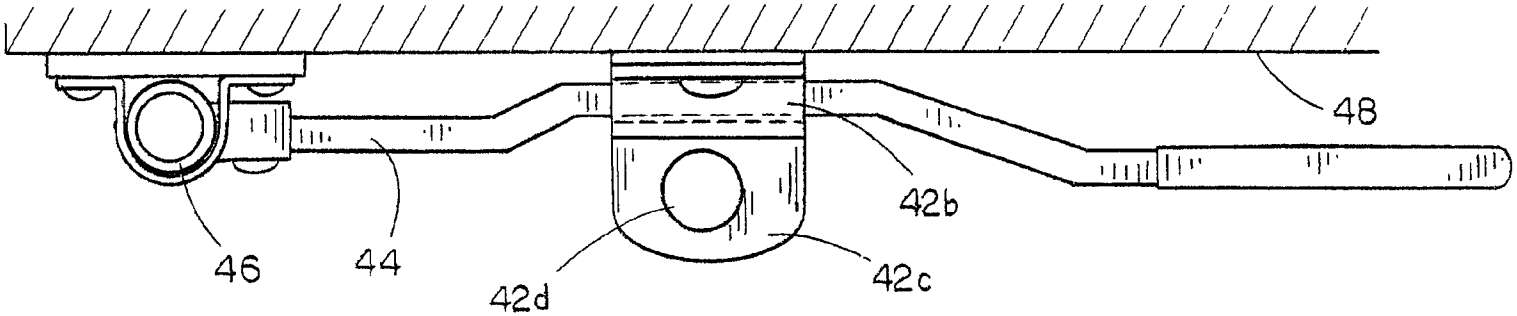
FIG. 4 is a top view of a cargo latch prior to installation of the security cover.
Figure 5:
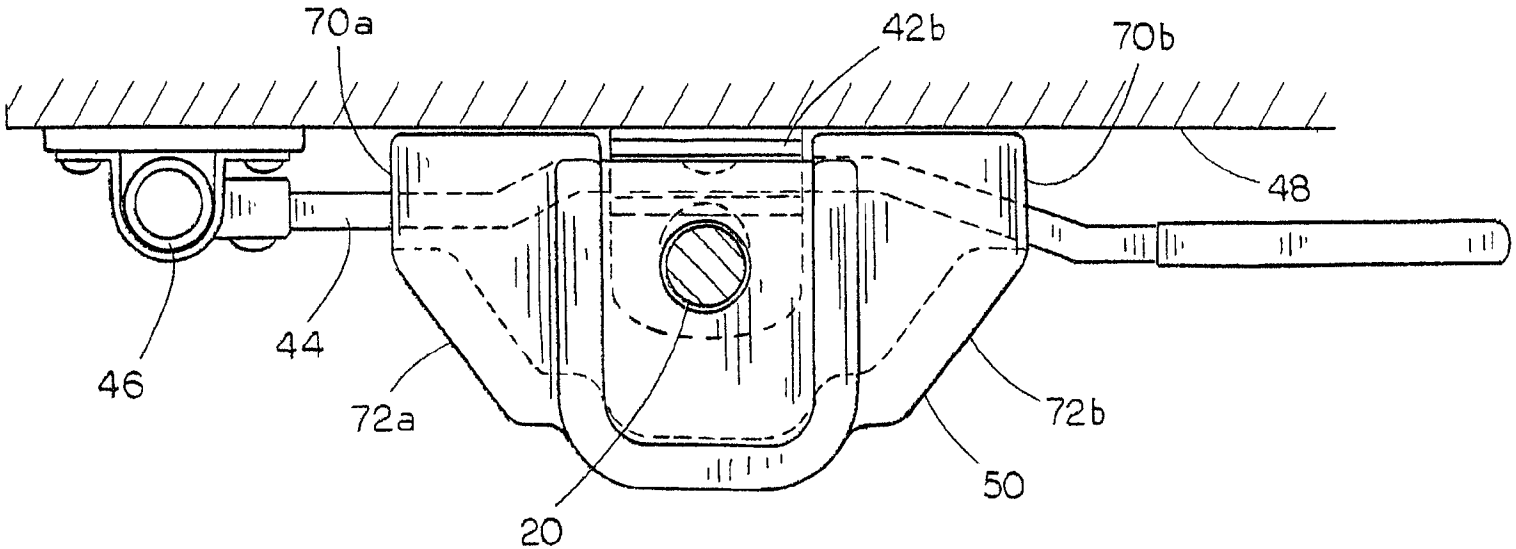
FIG. 5 is a top view of the cargo latch of FIG. 4, with the security cover and seal pin secured in place.

Seal pin 20 is used in conjunction with security cover 50 to secure the hasp 42 in position on a handle 44 of a conventional keeper bar 46 of a shipping container 48, as shown in FIGS. 2 and 3. Hasp 42 is of a conventional variety, having a stationary leg 42*a* and a pivoting leg 42*b*, and each leg having a projecting ear 42*c* with aligned apertures 42*d* (also shown in FIG. 4). In the prior art, a padlock, or similar securement device was secured to the ears 42*c* to prevent movement of the handle 44 from hasp 42. The present invention replaces such securement devices with the security cover 50 and seal pin 20 of the present invention, as shown in FIGS. 1,5 and 6.

Referring once again to FIGS. 1 and 6, security cover 50 includes a first vertically-oriented rectangular channel 51 of sheet steel, including a front wall 52 and opposing sidewalls 54 and 56, with the open portion of the channel facing rearwardly, to cover the hasp 42. A top plate 58 and bottom plate 60, oriented parallel to one another and perpendicular to front and sidewalls 52, 54 and 56, are mounted between the walls 52, 54 and 56 and extend to the rearward extent of the side walls 54 and 56. Top plate 58 is spaced downwardly from the upper edges of the front and sidewalls 52, 54 and 56 to form a parapet wall 62 above the top plate 58. Similarly, bottom plate 60 is spaced upwardly from the lower edges of the front and sidewalls 52, 54 and 56, to form an inverted parapet wall 64 below the bottom plate 60. In the preferred embodiment of the invention, parapet wall 62 includes a rearward wall 62*a* projecting upwardly from top plate 58.

Top and bottom plates 58 and 60 each include an aperture 66 and 68, respectively, which are vertically aligned and located for vertical alignment with the apertures 42*d* of the hasp ears 42*c*, when the cover 50 is positioned over the hasp 42. Apertures 66 and 68 have a diameter great enough to receive pin shaft 22 therethrough, but smaller than the diameter of the end caps 30. In addition, the distance between the top and bottom plates 58 and 60 is less than the length of pin shaft 22, so that the shaft will project outwardly from each plate, and receive an end cap 30 to secure the shaft22 and pin 20 in position through the apertures in the hasp ears.

As shown in FIGS. 1–3, security cover 50 also includes a second, horizontally oriented rectangular channel 70, which intersects the first channel 51 to form a general cruciform shape. Horizontal channel 70 includes a front wall 72, an upper wall 74 and a lower wall 76, and has a width between the upper and lower walls equal to the distance between the top and bottom plates 58 and 60. An opening is formed in each sidewall 54 and 56 of vertical channel 51, where the horizontal channel 70 intersect the vertical channel, forming an open cruciform shape which is placed against the side of the container 48 over the hasp 42 and portions of the handle 44.

Because horizontal channel 70 covers portions of handle 44, which are relatively close to the face of the container 48, the each front wall 72*a* and 72*b* that extends from the vertical channel 50 is sloped rearwardly from the vertical channel 50 to the outward ends 70*a* and 70*b* of the horizontal channel 70. In this way, the clearance between the end openings of the horizontal channel 70 and the handle 44 is much closer as shown in FIGS. 3 and 5, thereby reduces the likelihood of a vandal to attempt to break into the security cover 50 through the end openings of the horizontal channel.

Installation of the security cover 50 requires that the handle 44 first be moved to a "locked" position located generally flush against the side of container 48, as shown in FIG. 2. This rotates keeper bar 46 to lock the doors of the container 48 in a conventional fashion. The handle 44 is placed on the stationary leg42*a* of hasp 42, and pivoting leg 42*b* is pivoted over the handle to align the apertures 42*d* of the associated hasp ears 42*c*.

Security cover 50 is then positioned over the hasp 42 and handle 44 with the vertical channel 51 positioned over the hasp 42 and the horizontal channel 70 positioned over portions of the handle 44, so that the apertures 68 in top and bottom plates 58 and 60 are aligned with the hasp apertures, as shown in FIG. 6.

Security cover 50 is secured in position with seal pin 20 as follows. First, a locking ring 28 and end cap 30 are pressed down and locked onto the upper end of the seal pin shaft 22, as shown in FIGS. 1 and 6. This assembly is then journaled downwardly through the aperture 68 in the top plate 58, thence through the hasp apertures 42*d*, and finally through the aperture 68 in the bottom plate 60, as shown in FIG. 6.

A locking ring 28 is then placed in a second end cap 30 and the second end cap 30 is pressed on to the projecting lower end of pin shaft 22, until the locking ring 28 snaps into the groove 26 on the pin shaft 22. Once end caps 30 are locked on to the ends of pin shaft 22, it can be seen that there is no exposed portion of the pin shaft 22 which could be cut by a potential burglar or vandal.

To remove the security cover 50 from the container hasp 42 and handle 44, the security system 10 requires a special removal tool 80, as shown in FIGS. 7–10. This removal tool grips an outwardly projecting annular flange 82 on each end cap (shown in FIGS. 1, 6 and 9), as described in more detail hereinbelow. Generally, removal tool 80 includes a hydraulic pump 84 operated by a pump handle 86 to drive a punch 88 through the end of an end cap 30 to thereby shear the lock ring 26 and push the pin shaft 22 from the end cap 30.

Figure 7:
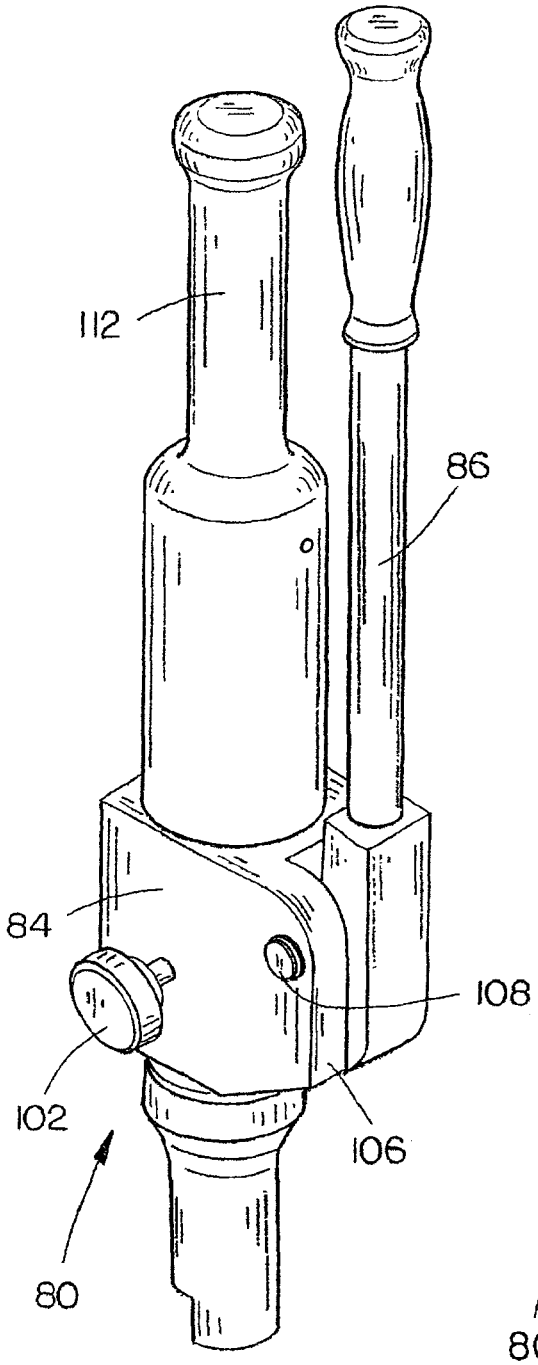
FIG. 7 is a pictorial view of the removal tool of the security system of the present invention.
Figure 8:
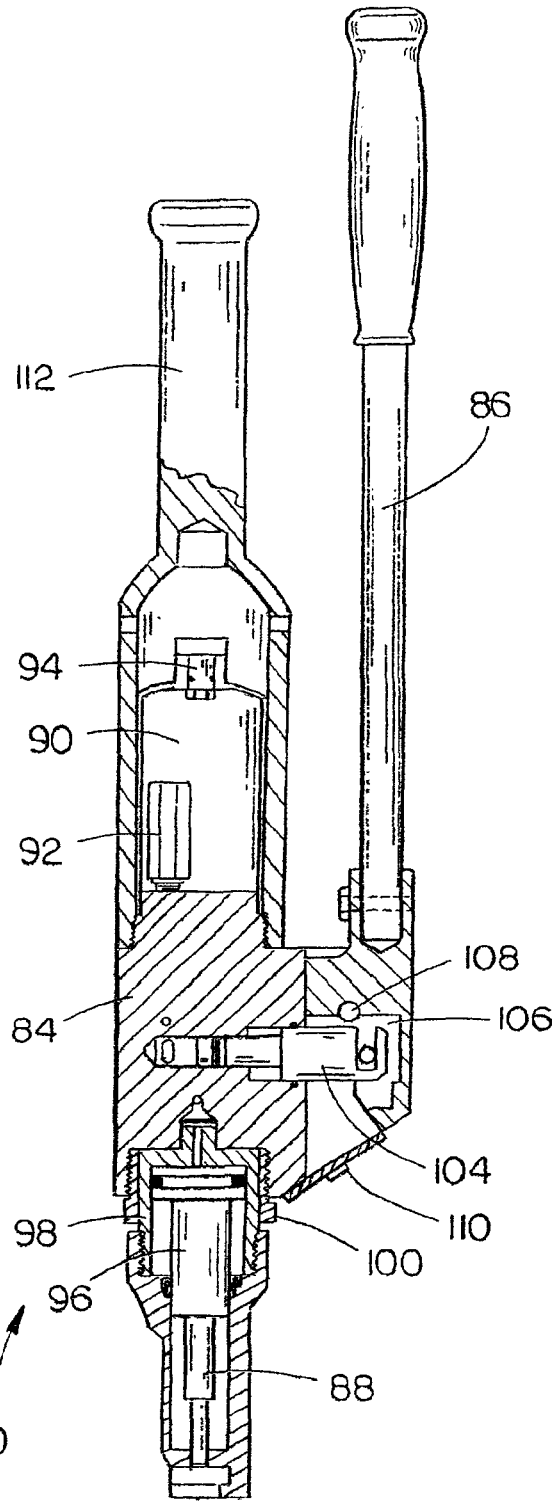
FIG. 8 is a cross-sectional view taken at lines 8—8 in FIG. 7.

As shown in FIG. 8, pump 84 includes an oil reservoir 90 on an upper end of the pump housing, with a relief valve 92 within the reservoir 90. A plug 94 permits the addition of oil to the reservoir. Pump 84 is operated to push a piston 96 in a cylinder 98 that is secured to a lower end of the pump by a locking ring 100. An operable release valve 102 (shown in FIG. 7) is tightened to cause pressure to build within the pump 84 to push the piston 96, and loosened to release pressure within the pump and allow the piston 96 to retract, in a conventional fashion for hydraulic pumps.

A plunger 104 projects from the side of pump 84 and is reciprocated by pump handle 86 to increase hydraulic pressure within pump 84. As shown in FIG. 7, pump handle 86 is pivotally mounted at a lower end between a pair of legs 106 on a pivot pin 108. The lower end of pump handle 86 acts against the plunger 104 (as shown in FIG. 8) as the handle is pivoted in a reciprocating motion. A finger guard 110 is provided at the extreme lower end of the handle 86, to prevent fingers from being pinched between the handle lower end and the pump 84. A handgrip 112 is secured to the upper end of pump 84, and encloses oil reservoir 90, to provide a place to hold and guide the removal tool during operation.

Figure 9:
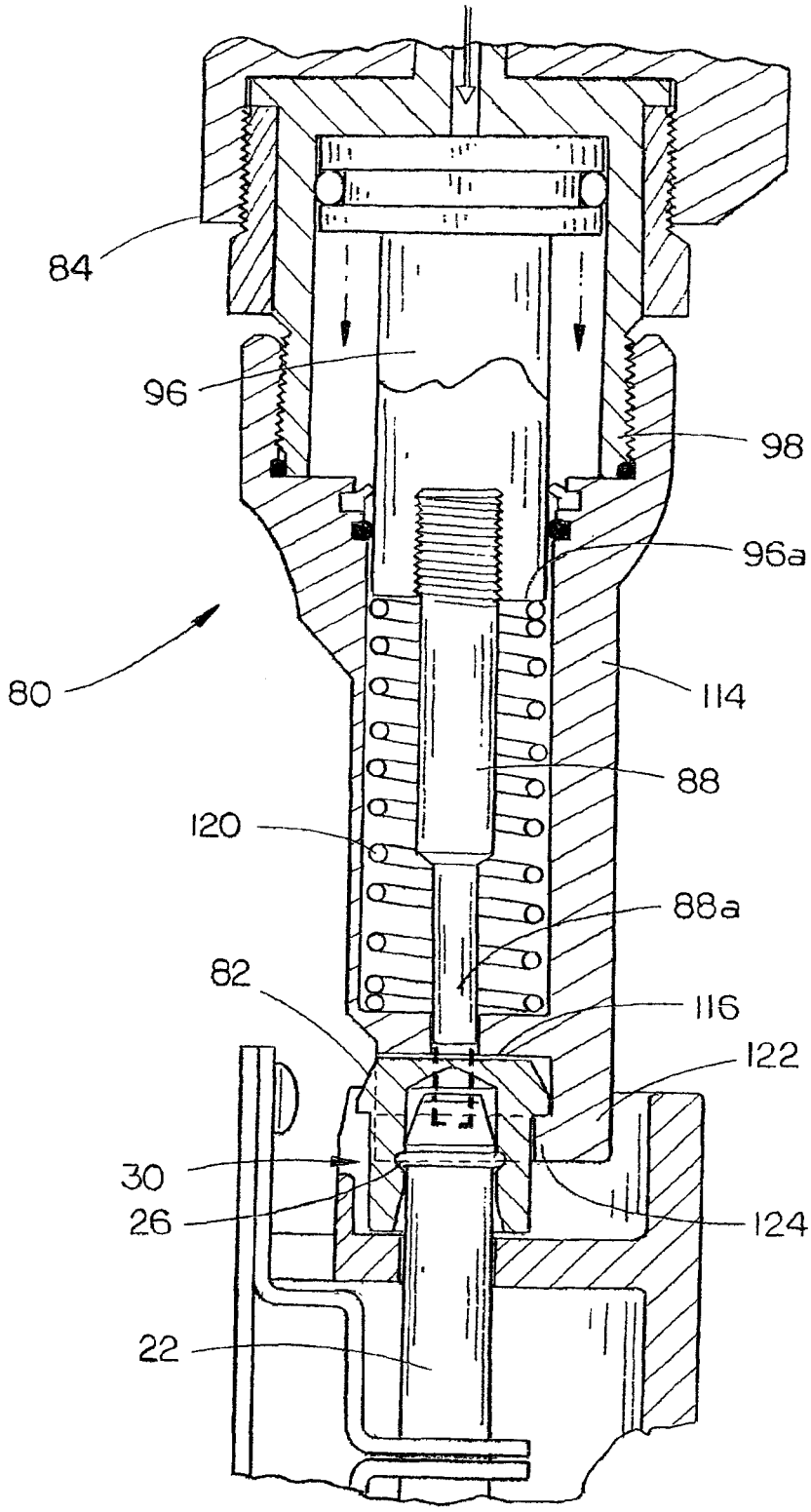
FIG. 9 is a cross-sectional view similar to FIG. 8, but with the removal tool engaged on the seal pin cap, showing the process of removal of the seal pin from the security cover.

Referring now to FIG. 9, punch 88 is secured to the lower end of piston 96, and projects downwardly therefrom. A punch housing 114 is secured the lower end of cylinder 98 and is a hollow, cylindrical tube with a closed lower end 116. Punch housing lower end 116 has an aperture 118 therein of a diameter slightly larger than the diameter of the punch 88, to permit passage of the lower end 88*a* of punch 88 therethrough. A coil spring 120 is interposed between the housing lower end 116 and the piston lower end 96*a* to bias the piston upwardly and thereby bias the punch 88 towards a retracted position. Once the pressure is released from the pump 84, spring 120 will return the piston 96 and punch 88 to the retracted position.

A semi-cylindrical wall 122 projects downwardly from the lower end of punch housing 114, flush with the cylindrical wall of the housing, and coaxial with the longitudinal axis of punch 88. A flange 124 projects radially inwardly from the inward face of the wall 122, at the lower end of the wall 122, to form a gripping ring which will latch onto the outwardly projecting flange 82 of an end cap, as shown in FIG. 9. In this way, cap 30 is retained in position against the lower end of punch housing 114 as punch 88 is forced through the end of cap 30.

In operation, the pressure release knob 102 on pump 84 is first rotated clockwise to close the valve and permit pressure to build within the pump 84, as shown in FIG. 7. The lower end of punch housing 114 is then positioned adjacent either the upper or lower end cap 30 on the sealed security cover 50, with the open portion of the semi-cylindrical wall 122 facing rearwardly towards the pin 20 and container 48. Removal tool 80 is then slid towards seal pin 20 until the flange 124 on the semi-cylindrical wall 122 hooks under the flange 82 on the end cap 30, as shown in FIG. 9. In this position, the punch 88 is centered along the longitudinal axis of pin shaft 22.

One hand then grips the handgrip 112 while the other pumps the pump handle 86, to build up hydraulic pressure in the pump 84, as shown in FIG. 10. Once the pressure within pump 84 builds to a sufficient pressure, the punch 88 will be forced through the end cap 30 and push the pin shaft 22 so as to shear the locking ring 26. In this way the pin shaft 22 will be released from the seal pin 20, and may be removed from the security cover 50. The removal tool 80 is then removed from the security cover 50. Typically, it will be necessary to rotate the pressure release knob 102 counterclockwise in order to release the build-up of hydraulic pressure and release the remaining portion of the end cap 30 from the lower end of the punch housing 114.

The security cover 50 is retained for use on other shipping containers, while the end cap 30 and remaining seal pin 20 are disposed of in some appropriate fashion.

It can be seen that the security system 10 of the present invention will overcome many of the drawbacks of prior art securement devices. The security cover 50 covers both the hasp 42 and portions of handle 44 to prevent tampering. The projecting parapet walls 62 and 64 of security cover 50 prevent a thief from accessing the seal pin 20 with a saw or cutting torch, while resisting any attempt to place a pry bar between the end cap 30 and top or bottom plates 58 or 60.

The seal pin 20 permits simple attachment of the end caps 30 on to the shaft 22, and simple securement of the cover 50 to the container hasp 42. No special tools, keys, or expertise are needed to secure a shipping container 48. The locking rings 26 prevent removal of the end caps 30 from the pin shaft 22 by any other means than the special removal tool 80.

Removal tool 80 is designed specifically to remove the seal pin 20 from the security cover 50, and works reliably, efficiently, and without any special expertise.

Whereas the invention has been shown and described in connection with the preferred embodiment thereof, many modifications, substitutions and additions may be made which are within the intended broad scope of the appended claims.

I claim:

1. A security system for a shipping container of the type having doors with a rotatable keeper bar and operating handle to be secured by a hasp having a pair of ears with vertically-aligned apertures, comprising:

a security cover, including:

a vertical channel having upper and lower ends, a front wall and opposing sidewalls extending rearwardly from the front wall;

a top plate mounted in the channel, perpendicular to the front and sidewalls and extending rearwardly the extent of the sidewalls;

a bottom plate mounted in the channel, perpendicular to the front and sidewalls and extending rearwardly the extent of the sidewalls;

a pair of vertically aligned apertures formed in the top and bottom plates, spaced from the front and sidewalls, for receiving a seal pin therethrough; and a pair of horizontally aligned openings formed in the sidewalls, extending forwardly from rearward edges of the sidewalls, for receiving a shipping container handle therethrough;

a seal pin for use in retaining the security cover on the hasp of the shipping container, including:

a rigid elongated cylindrical shaft, having upper and lower ends;

an upper annular groove formed in the shaft spaced from the upper end and extending around a circumference of the shaft;

a lower annular groove formed in the shaft spaced from the lower end and extending around a circumference of the shaft;

a pair of end caps for securement to each end of the shaft, each cap having an outward end, an inward end and a central bore extending from the inward end towards the outward end to form a generally cylindrical sidewall with inward and outward surfaces;

each end cap including an annular groove formed on the inward surface of the sidewall, parallel to the ends and located a distance from the outward end to lie adjacent one of said annular grooves in the shaft when the cap is secured to an end of the shaft; and a pair of locking rings for securing each end cap to an end of the shaft, each locking ring having a split toroidal shape, with a diameter such that when the ring is journaled between a pair of associated grooves of an end cap and one end of the shaft it will prevent removal of the end cap from the shaft; and a removal tool for removing the seal pin from the security comprising:

an operable pump mounted within a housing, the housing having upper and lower ends and a sidewall;

a pump handle connected to the pump and operable to selectively pump up pressure within the pump housing;

an operable release valve for selectively permitting or preventing the build-up of pressure in the pump upon operation of the pump handle;

a piston reciprocatingly mounted within a cylinder attached to the lower end of the pump, the piston operable to move downwardly in response to a build up of pressure within the pump;

a fluid reservoir fluidly connected to the pump, for supplying fluid to be placed under pressure in the pump;

a punch secured to the piston for movement therewith, the punch having a free lower end;

a punch housing secured to the lower end of the pump and enclosing the punch therein, said punch housing having a closed lower end with an aperture through which the punch lower end will slide and project upon operation of the pump to move the piston downwardly; and means on the lower end of the punch housing for gripping a seal pin end cap and retain the cap in position during operation of the punch to a lower position projecting from the punch housing.

* * * * *